US007098861B2

(12) United States Patent
Theobold et al.

(10) Patent No.: US 7,098,861 B2
(45) Date of Patent: Aug. 29, 2006

(54) HOOKED STUB COLLINEAR ARRAY ANTENNA

(75) Inventors: David Theobold, Akron, OH (US); Stephen Saliga, Akron, OH (US); James Mass, North Roaylton, OH (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 11/023,767

(22) Filed: Dec. 28, 2004

(65) Prior Publication Data

US 2006/0139229 A1 Jun. 29, 2006

(51) Int. Cl.
*H01Q 9/16* (2006.01)

(52) U.S. Cl. ..... 343/801; 343/806; 343/895

(58) Field of Classification Search ..... 343/801, 343/806, 813, 895
See application file for complete search history.

(56) References Cited

U.S. PATENT DOCUMENTS 2,380,333 A * 7/1945 Scheldorf ..... 343/801
3,680,147 A * 7/1972 Redlich ..... 343/792
4,031,537 A * 6/1977 Alford ..... 343/704
4,160,978 A * 7/1979 DuHamel ..... 343/742
4,250,509 A * 2/1981 Collins ..... 343/806
4,872,021 A 10/1989 Tabakov et al.
6,005,530 A 12/1999 Jovanovich et al.
6,529,171 B1 3/2003 Le Balier et al.
6,717,555 B1 4/2004 Teillet et al.
6,919,859 B1 * 7/2005 McCarthy et al. ..... 343/895

* cited by examiner

*Primary Examiner*—Tho Phan
(74) *Attorney, Agent, or Firm*—Tucker Ellis & West LLP

(57) ABSTRACT

A hooked stub collinear array antenna formed from a single conductor. The antenna operates at a design frequency having an associated wavelength. The antenna includes a plurality of radiating elements that are substantially one half the wavelength. The radiating elements are aligned with a longitudinal axis of the antenna. The antenna further includes a delay element connected between each of the plurality of radiating elements. The delay element is aligned with a transverse axis approximately ninety degrees from the longitudinal axis. The delay element extends approximately one quarter of the wavelength from the longitudinal axis and adjacent delay elements of a plurality of delay elements are sequentially rotated at 90 degree intervals relative to each other about the longitudinal axis. The total length of the delay element is approximately one half the wavelength.

25 Claims, 10 Drawing Sheets

HOOKED STUB COLLINEAR ARRAY ANTENNA

BACKGROUND OF THE INVENTION

The present invention relates generally to wireless communications systems and more particularly to a hooked stub collinear antenna and a method for making the same.

For a wireless communications system, an omni-directional antenna is often desirable such that the coverage area, i.e., transmission and/or reception, is generally uniform in all azimuth directions relative to the location of the antenna. As a particular example, for wireless network access points and bridges, an antenna having an omni-directional pattern with vertical polarization characteristics, a uniform horizontal plane pattern, low cross-polarization characteristics, and moderate gain, e.g., 5 to 10 decibels referenced to an isotropic radiator (5 to 10 dBi), and with greater than five percent bandwidth is desirable.

A number of approaches are commonly used to implement omni-directional antennas. More specifically, these approaches often use collinear aperture fed arrays, periodic loaded structures, or periodic sleeve dipoles. Generally, omni-directional antennas implemented using any one of these approaches include many parts, and are often fragile and difficult to manufacture. These antennas also typically have narrow bandwidths. For example, wire helix sections typically include many parts and are fragile and difficult to construct, having bandwidths less than five percent. Furthermore, wire stub sections generally have asymmetrical horizontal plane symmetry and narrow bandwidths. Approaches including a variety of periodic aperture fed or loaded structures printed on circuit board materials are easy to fabricate and are rugged. However, an omni-directional antenna using periodic aperture fed or loaded structures printed on one or more circuit boards typically lacks horizontal plane symmetry.

Thus, there exists a need for an omni-directional antenna with vertical polarization characteristics, a uniform horizontal plane pattern, low cross-polarization characteristics, and moderate gain, with greater than five percent bandwidth. Moreover, such an omni-directional antenna should be easy to manufacture.

SUMMARY OF THE INVENTION

The present invention provides an omni-directional antenna with vertical polarization characteristics, a uniform horizontal plane pattern, low cross-polarization characteristics, and moderate gain, with greater than five percent bandwidth. Moreover, the omni-directional antenna of the present invention is easy to manufacture.

In accordance with the present invention there is disclosed herein a hooked stub collinear array antenna formed from a single conductor. The antenna operates at a design frequency having an associated wavelength. The antenna includes a plurality of radiating elements that are substantially one half the wavelength. The radiating elements are aligned with a longitudinal axis of the antenna. The antenna further includes a delay element connected between each of the plurality of radiating elements. The delay element is aligned with a transverse axis approximately ninety degrees from the longitudinal axis. The delay element extends approximately one quarter of the wavelength from the longitudinal axis. The total length of the delay element is approximately one half the wavelength.

In accordance with yet another aspect of the present invention, the proximal ends of the delay elements extend along a transverse axis and are serially rotated ninety degrees in ether a clockwise or counter clockwise direction.

In accordance with yet another aspect of the present invention, the delay elements are substantially similar. Furthermore, the delay elements are symmetric about and substantially perpendicular to the longitudinal axis.

Further in accordance with the present invention there is disclosed herein another hooked stub collinear array antenna formed from a single conductor and configured to operate at a design frequency having a wavelength. The antenna includes a plurality of radiating elements that are substantially one half the wavelength in length and aligned with a vertical axis and a delay element connected between each of the plurality of radiating elements. The delay elements are aligned with a horizontal axis approximately ninety degrees from the vertical axis extending approximately one quarter of the wavelength. The total length of the delay element is approximately one half the wavelength.

In accordance with yet another aspect of the present invention, the delay elements are symmetric about and substantially perpendicular to the vertical axis.

By virtue of the foregoing, there is thus provided an omni-directional antenna with vertical polarization characteristics, a uniform horizontal plane pattern, low cross-polarization characteristics, and moderate gain, with greater than five percent bandwidth that is easy to manufacture.

The advantages of this configuration lie in the construction. In a preferred embodiment, a single conductor is used. Thus, there is one part. The plethora of pieces normally associated with a collinear array is reduced to a single wire with multiple bends. The resultant antenna has excellent horizontal plane symmetry, is compact in its "diameter", is low loss, and has no connections other than at a single feed point, resulting in high reliability. Furthermore, the array is scalable to the extent that more elements provide more gain, with each added set adding incremental gain, up to a limit on the order of twenty elements, which is a general characteristic of collinear arrays.

These and other objects and advantages of the present invention will become readily apparent to those skilled in this art from the following description wherein there is shown and described a preferred embodiment of this invention, simply by way of illustration of one of the best modes suited to carry out the invention. As it will be realized, the invention is capable of other different embodiments and its several details are capable of modifications in various obvious aspects all without departing from the spirit of the present invention. Accordingly, the drawings and descriptions will be regarded as illustrative in nature and not as restrictive.

BRIEF DESCRIPTION OF THE DRAWINGS

The accompanying drawings, which are incorporated in and constitute a part of this specification, illustrate embodiments of the present invention and, together with a general description of the invention given above, and the detailed description given below, serve to explain the principles of the present invention.

DETAILED DESCRIPTION OF THE DRAWINGS

Figure 1A:
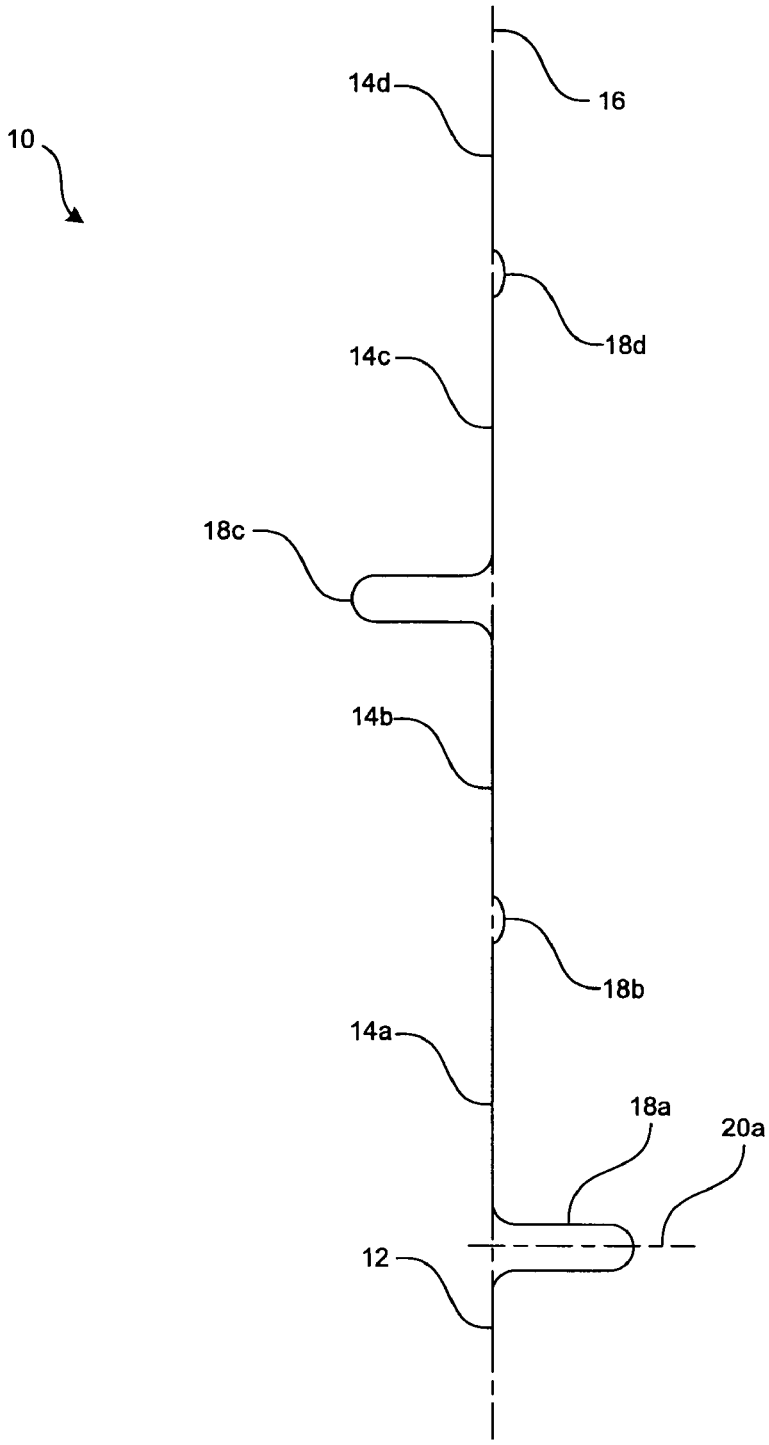
FIG. 1A is a side view of a first embodiment of an antenna in accordance with principles of the present invention.

With reference to FIG. 1A, one embodiment 10 of an antenna in accordance with the principles of the present invention is shown. It should be appreciated that the embodiment 10 is shown for the sole purposes of illustration, and not for limiting the present invention. In this regard, FIG. 1A illustrates a collinear array antenna 10 formed from a single conductor 12. The antenna 10 is designed to operate about a particular frequency, i.e., a center frequency, having a corresponding wavelength designed by the Greek letter lambda (λ). The center frequency and the wavelength are related by following equation:

$$f=c/\lambda,$$

where f is the center frequency, λ is the wavelength, and c is the speed of light. Antenna 10 is comprised of a plurality of radiating elements 14*a–d*. The radiating elements 14*a–d* are substantially one half wavelength in length, and are aligned with a longitudinal axis, generally indicated by the centerline found at reference numeral 16. A delay element 18*a–d* is connected between each of the plurality of radiating elements 14*a–d*. The delay elements 18*a–d* are aligned with a transverse axis, an exemplary one of which is indicated at reference numeral 20*a*, approximately ninety degrees from the longitudinal axis 16. The delay elements 18*a–d* extend approximately one quarter of the wavelength (λ/4), as best shown in shown in FIG. 1B, while the total length of each delay element 18*a–d* is approximately one half the wavelength (λ/2), e.g., λ/4+λ/4.

As shown in FIG. 1A, there are at least four radiating elements 14*a–d*. However, the present invention is not limited to four radiating elements 14*a–d*. For example, and as will be described in more detail hereinafter, the number of radiating elements 14*a–d* is a multiple of four. Furthermore, and as will also be described in more detail hereinafter, the proximal ends of the delay elements extend along a transverse axis, e.g., transverse axis 20*a*, and are serially rotated ninety degrees in a clockwise or counter clockwise direction about the longitudinal axis 16, as best shown in FIG. 1D.

Figure 1B:
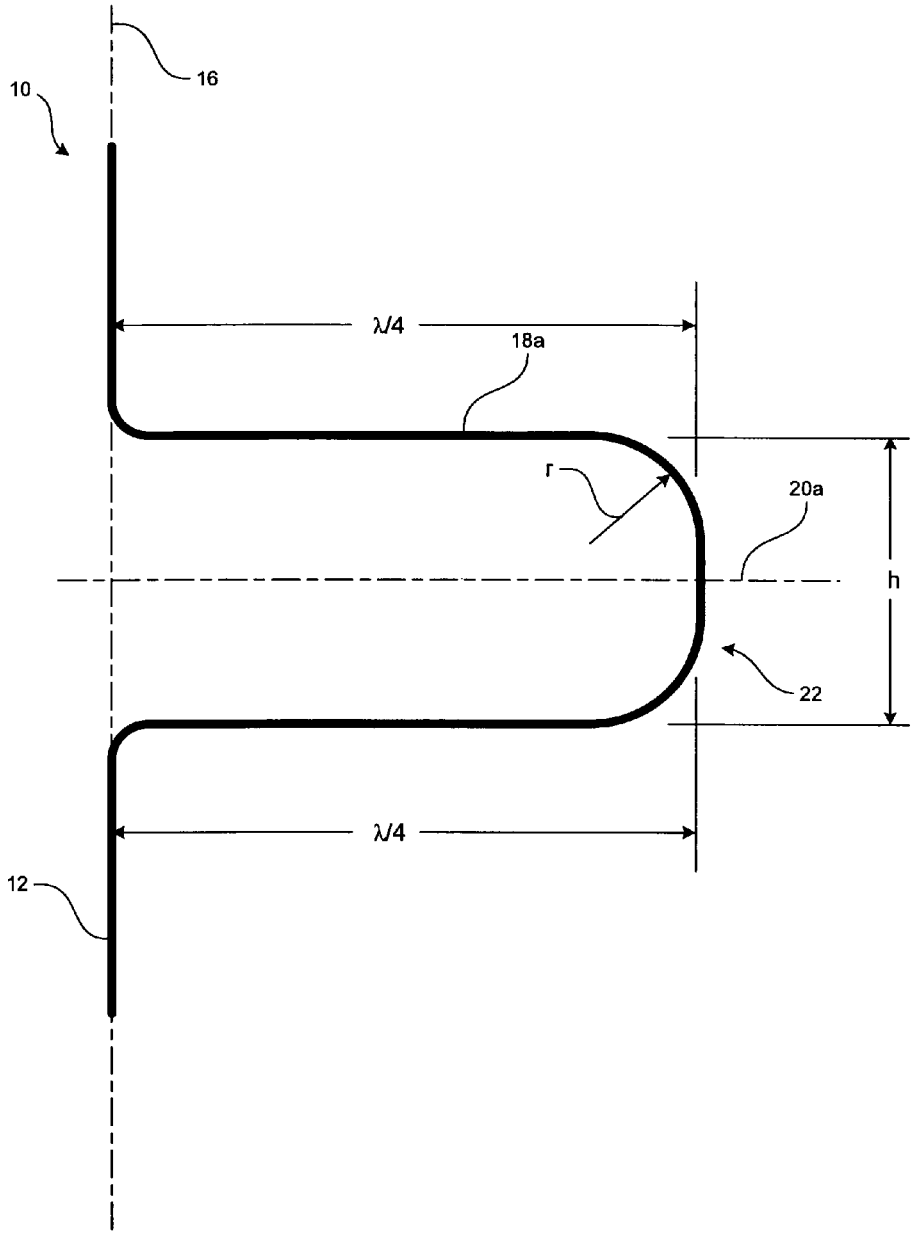
FIG. 1B is a side view of a delay element included in the antenna of FIG. 1A.

FIG. 1B shows a side view of a delay element 18*a* included in the antenna 10 of FIG. 1A. As generally indicated at reference numeral 22, the delay element 18*a* is substantially U shaped. Although only one delay element 18*a* is shown in FIG. 1B, it will be appreciated that according to one aspect of the present invention, each delay element 18*a–d* included in antenna 10 is similarly shaped. For U shaped delay elements 18*a–d*, the radius (r) of the bend should be much less than the wavelength (λ), r<<λ, for example as shown in this embodiment 10, r<<λ/4. Preferably, the radius (r) is generally less than or equal to one twentieth of the wavelength, or λ/20.

Ideally, and as will be shown hereinafter, the delay elements are square. That is to say that the delay elements have no curvature or radius (r). However, because the antenna 10 and the delay elements 18*a–d* are formed from a single conductor 12, this is physically impractical. Thus, some radius (r) results from the formation of the delay elements 18*a–d* in the single conductor 12. In accordance with one aspect of the present invention, the antenna 10 is very forgiving of the shape of the delay elements 18*a–d*. Thus, the exact shape of the bends of delay elements 18*a–d* is not critical; however, each delay element 18*a–d* is similarly shaped to cancel out, for example, asymmetrical radiation exhibited by the antenna 10. Those of ordinary skill in the art will appreciated that the pattern function of the antenna 10 would be likewise effected.

Also ideally, the height (h) of each delay element 18*a–d* is near zero. However, this is physically impossible. Thus, the height (h), like the radius (r), is much less than the wavelength (λ), h<<λ.

Figure 1C:
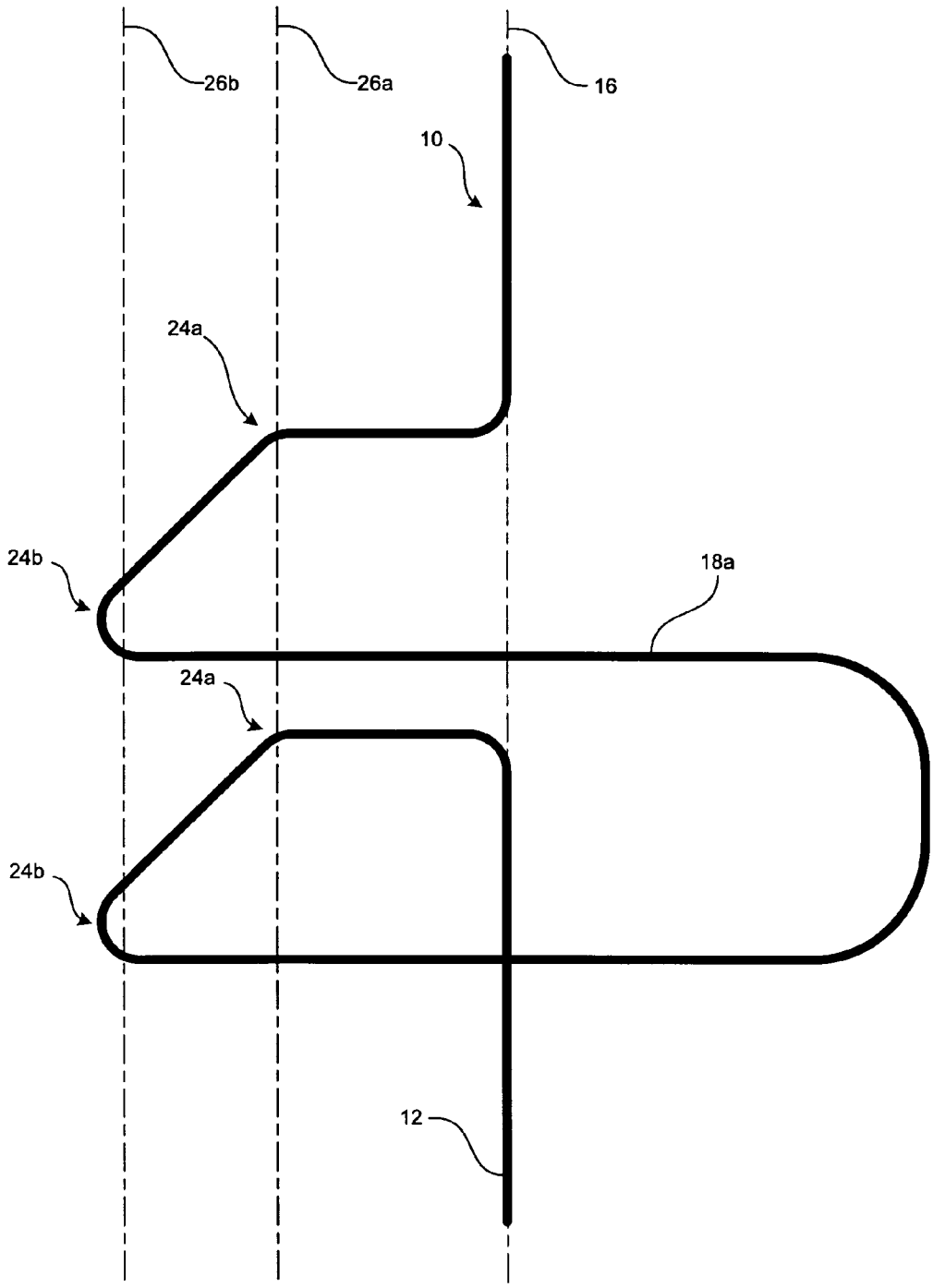
FIG. 1C is a perspective view of the delay element of FIG. 1B that has been hooked.
Figure 1D:
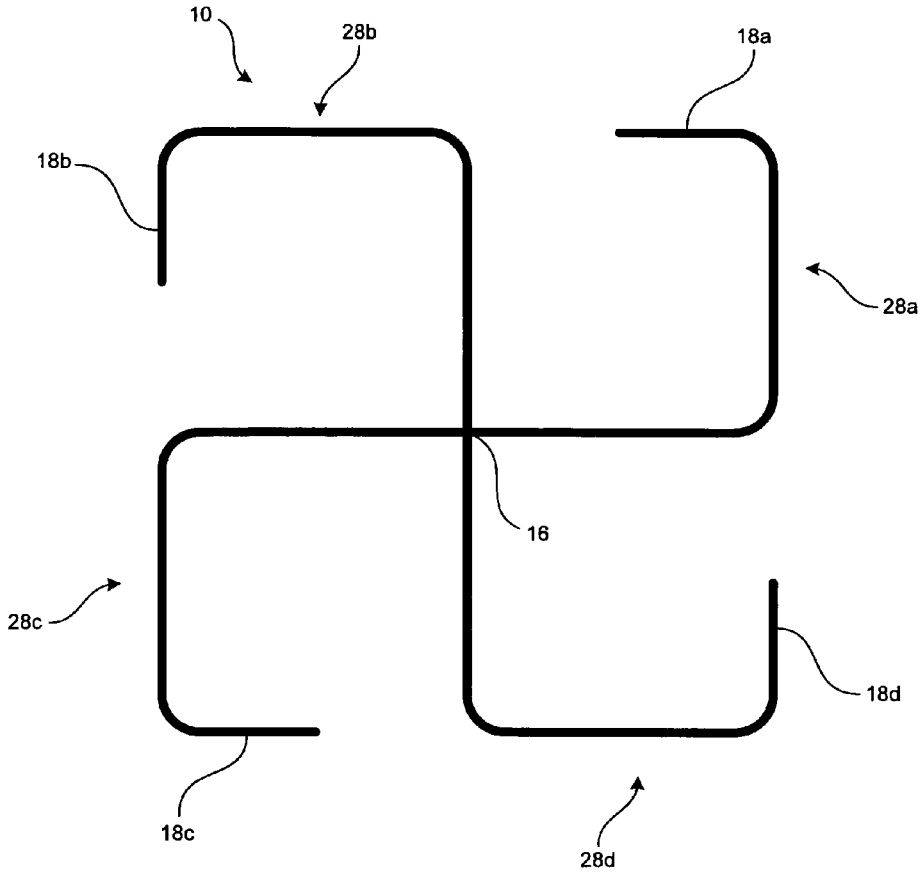
FIG. 1D is a top view of the antenna of FIG. 1A with the delay elements hooked.

FIG. 1C shows a perspective view of the delay element 18*a* of FIGS. 1A and 1B that has been hooked. More specifically, as shown in FIG. 1C, the delay element 18*a* comprises substantially ninety degree bends 24*a*, 24*b* about axes 26*a*, 26*b* parallel to the longitudinal axis 16 of the antenna 10. A benefit of hooking the delay elements 18*a–d* is that it increases the useable bandwidth of the antenna 10. Typically, a collinear array antenna has a bandwidth of 2–3%, i.e., the bandwidth of the antenna is equal to 2–3% of the center or design frequency of the antenna. However, by hooking the delay elements 18*a–d*, typically antenna 10 has a bandwidth greater than 5%, and often as high as 10%.

FIG. 1D shows a top view of the antenna 10 with the delay elements 18*a–d* hooked. As generally indicated at references numerals 28*a–d*, respectively, the delay elements 18*a–d* are substantially J shaped when viewed from the top. Furthermore, the delay elements 18*a–d* are symmetric about the longitudinal axis 16 and substantially perpendicular to the longitudinal axis 16. Additionally, the delay elements 18*a–d* are serially rotated in either a clockwise or counter clockwise direction along the longitudinal axis 16.

Thus, referring to FIGS. 1A–D, the overall geometry of the antenna 10 is critical. The delay elements 18*a–d* are bent or hooked to increase the bandwidth of the antenna 10. Adjacent delay elements 18*a–d* are rotated ninety degrees. Furthermore, this rotation is in the same direction to cancel out asymmetry. In addition to each delay element 18*a–d* being hooked and rotated, each delay element 18*a–d* is also substantially similar.

Figure 2:
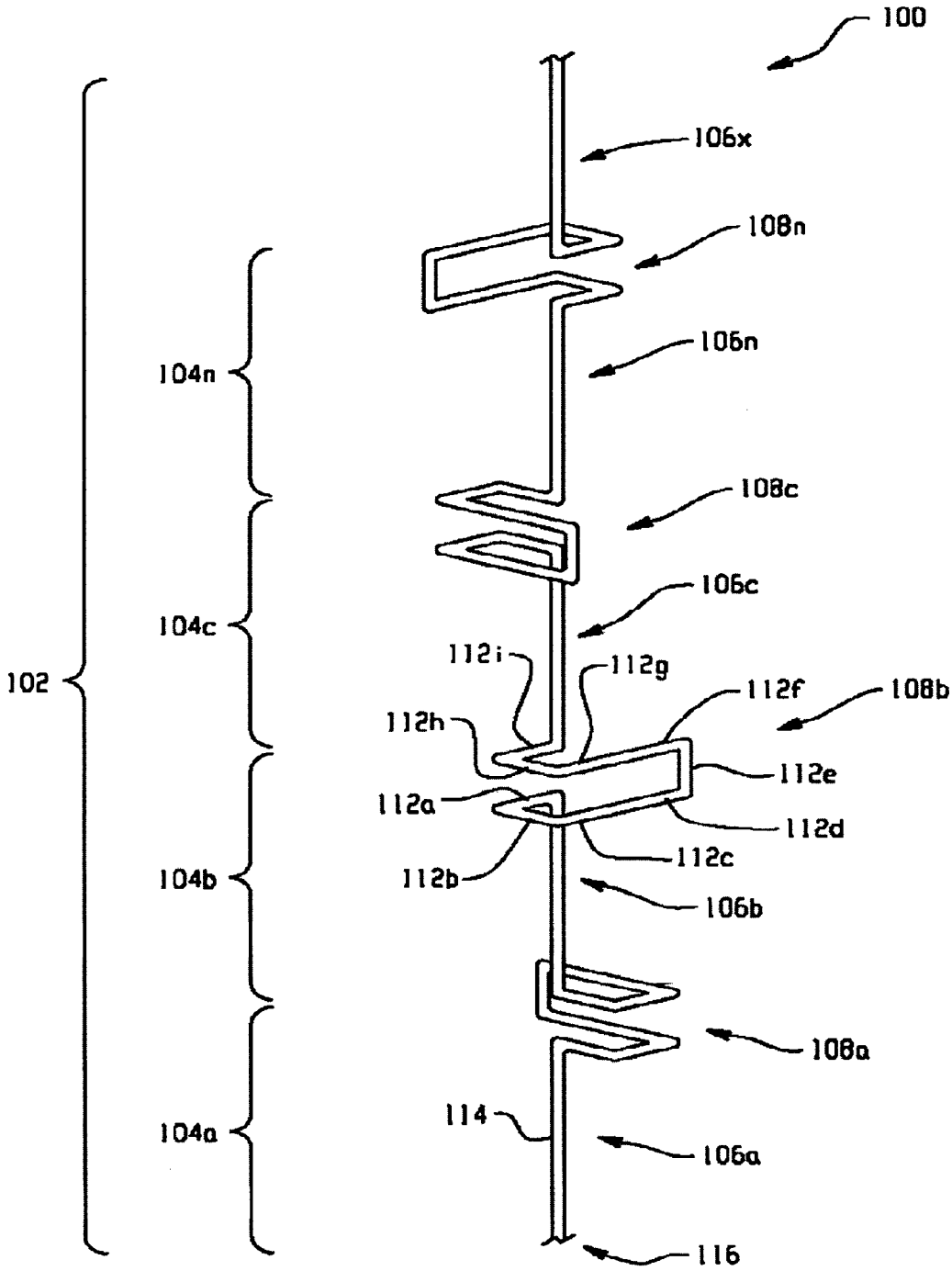
FIG. 2 is a perspective view of a second embodiment of an antenna in accordance with the principles of the present invention.

With reference to FIG. 2, a second embodiment 100 of an antenna in accordance with the principles of the present invention is shown. FIG. 2 illustrates a hooked stub collinear antenna 100 comprised of a vertical array 102 of sets 104*a–n* of radiating and delay elements 106*a–n*, 108*a–n*, where "n" represents any practical number of sets or elements. As used herein the terms "delay element" and "stub" are synonymous. The antenna 100 is also designed to operate at a center frequency having a corresponding wavelength (λ). As with the other dipole radiators, the length of the radiating elements 106*a–n* is approximately equal to the wavelength (λ) divided by two, or λ/2. Furthermore, corresponding points of adjacent radiating elements, for example, radiating elements 106*a*, 106*b*; 106*b*, 106*c*; etc., are separated by a distance approximately equal to one half wavelength (λ/2) at the design or center frequency of the antenna 100, there possibly being some adjustment due to the delay elements, e.g., 108*a*, 108*b*, etc., being located there between. The delay elements 108*a–n* each provide one half wavelength (λ/2) of delay and are at right angles to the radiating elements 106*a–n*. Each delay element 108*a–n* includes two approximately quarter wavelength (λ/4) segments, as was best shown in FIG. 1B, that are at a right angles to the radiating elements 106*a–n*, and that double back on themselves and continue vertically with the next radiating element 106*a–n*. Thus, there is a series of radiating, delay, radiating, delay, etc. elements, 106*a*, 108*a*, 106*b*, 108*b*, 106*c*, 108*c*, . . . 106*n*, 108*n*, ending in a single quarter wavelength (λ/4) radiating element 106*x*.

Again, the total length of each delay element 108*a–n* is approximately equal to the wavelength (λ) divided by two, or λ/2. The exact shape of the delay elements 108*a–n* is not critical. However, each delay element 108*a–n* is similarly configured and serially rotated ninety degrees. As will be shown in FIG. 4, the delay elements 108*a–n* doubling back on themselves, i.e., being hooked, widens the bandwidth of the antenna 100, providing a wider array 102 bandwidth, e.g., greater than five percent, than that of conventional lumped element arrays.

In the embodiment 100 shown in FIG. 2, each delay element 108*a–n* is comprised of nine equal length segments 112*a–i* (only shown for delay element 108*b* for ease of illustration). However, in other embodiments, the delay elements 108*a–n* need not include nine equal length segments 112*a–i*. As shown, segments 112*a–d* and 112*f–i* are perpendicular to the vertical array 102, while segment 112*e* is parallel. Thus, the only adjustment of the one half wavelength (λ/2) spacing between radiating elements 106*b* and 106*c*, if made, would be due to segment 112*e*, equal in length to the wavelength divided by thirty-six, or λ/36. An adjustment of this magnitude has not been found to significantly impact the performance of the antenna 100, and, therefore, has not been made for the embodiment 100 shown in FIG. 2. In other embodiments, such an adjustment is suitably made as desired. In addition, it will be appreciated that the sum of the lengths of segments 112*a–i* is equal to one half wavelength, or λ/2. Furthermore, the sum of the lengths of segments 112*a–d* is equal to one quarter wavelength, or λ/4. Similarly, the sum of the lengths of segments 112*f–i* is also equal to one quarter wavelength, or λ/4.

More specifically, for delay element 108*b*, segment 112*a* extends at a right angle from radiating element 106*b*. Segment 112*b* continues from segment 112*a*, and is also at a right angle to radiating element 106*b* and segment 112*a*. Segment 112*c* continues at a right angle from segment 112*b*, and is likewise at a right angle to radiating element 106*b*. Segment 112*d* continues in-line or linearly from segment 112*c*, at a right angle to radiating element 106*b*. Segment 112*e* continues at a right angle from segment 112*d* in parallel with radiating element 106*b*. Segment 112*f* continues at a right angle from segment 112*e*, and is also aright angle to radiating element 106*b*. Segment 112*g* continues linearly from segment 112*f*, at a right angle to radiating element 106*b*. Segment 112*h* continues at a right angle from segment 112*g*, and is at a right angle to radiating element 106*b*. Segment 112*i* continues at a right angle from segment 112*h*, and is a right angle to radiating element 106*b*. Radiating element 106*c* continues on from segment 112*i*, at a right angle, and is in-line with radiating element 106*b*. Thus, segments 112*a–i* comprise a delay element 108*a* that is substantially rectangular in shape. Moreover, segments 112*a–i* form a delay element 108*b* that doubles back on itself to widen the bandwidth of the antenna 100.

As also shown in FIG. 2, the delay elements 108*a–n* are serially rotated about the axis formed by the collinear radiating elements 106*a–n* or the central axis of the antenna 100, in ninety degree increments or every ninety degrees (0, 90, 180, 270, etc.). Rotating the delay elements 108*a–n* about the axis formed by the collinear radiating elements 106*a–n* of the antenna 100 every ninety degrees cancels out horizontal plane polarization components and provides superb horizontal plane symmetry. The horizontal plane symmetry will be shown in FIGS. 3 and 7.

Still referring to FIG. 2, and in a preferred embodiment, antenna 100 is constructed or formed from a single piece of solid copper wire 114 having a radius substantially less than the wavelength, typically less than λ/50. However, any electrically conductive material is suitably used, such as, for example, aluminum, brass, tin, silver, gold, etc., or an alloy or combination thereof. Moreover, these materials are formed into an elongated solid cylindrical structure, such as a wire, or hollow core structure, such as a tube. In addition, it should be appreciated that the radius of these structures can vary, as limited by the design frequency of the antenna 100.

It should also be appreciated that a feed (not shown) is attached to the bottom or end 116 of wire 114. For example, a feed is suitably a wire, such as a coaxial cable, or a connector, such as a bayonet or threaded connection type.

A novel aspect of the present invention is the construction or method of making a hooked stub collinear array antenna. For example, an antenna 110 is formed from a single wire 114. Referring also to FIGS. 1A–D, and more specifically, each delay element 18*a–d* is sequentially formed by bending the single conductor 12, e.g., wire 114, into a "U-shape," and bending the "U-shape" back on its self to hook the delay element 18*a–d*. The single conductor 12 is then rotated ninety degrees before forming the next delay element 18*a–d*. The numerous pieces typically associated with a conventional collinear array are reduced to a single wire with multiple bends. The resultant antennas 10, 100 have excellent horizontal plane symmetry, are compact in their "diameter," are low loss, and have no connections other than at the feed point 116, resulting in high reliability.

In addition, the array 102 is scalable to the extent that more radiating elements 106*a–n* provides more gain, with each added set of four radiating and delay elements 106*a–n*, 108*a–n* adding incremental gain, up to a limit on the order of twenty elements, a general characteristic of collinear arrays. The following table shows the typical relationship between peak gain and the number of elements (n), using an antenna with eight elements, e.g., n=8, as a reference.

| Δ dB | Elements | Gain (dB) | Frequency (MHz) | Length (meters) | Δ Gain (dB) |
|---|---|---|---|---|---|
| Reference | 8 | 10.47 | 5450 | 0.2860 | Reference |
| 0.92 | 12 | 11.39 | 5350 | 0.4335 | 0.92 |
| 0.50 | 16 | 11.89 | 5350 | 0.5811 | 1.42 |
| 0.45 | 20 | 12.34 | 5250 | 0.7280 | 1.87 |
| 0.34 | 24 | 12.68 | 5150 | 0.8755 | 2.21 |
| 0.30 | 28 | 12.98 | 5050 | 1.0230 | 2.51 |
| 0.20 | 32 | 13.18 | 4850 | 1.1622 | 2.71 |

For example, as shown in the first row of data, the antenna including eight elements has a peak gain of 10.47 decibels (dB) at a frequency of 5,450 Megahertz (MHz) and a length of 0.2860 meters. As shown in the left and right most columns, little additional gain is afforded by increasing the number of elements beyond twenty.

Figure 3:
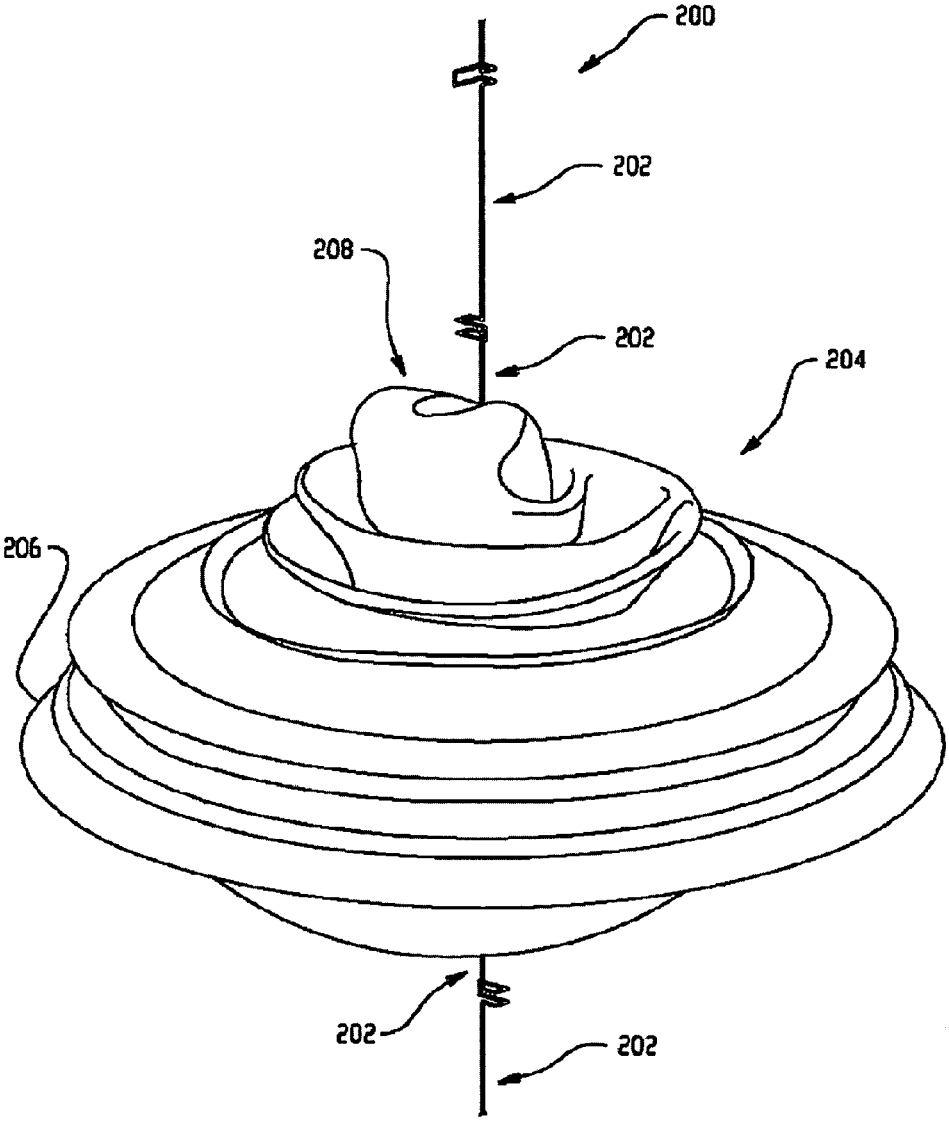
FIG. 3 is an illustration of the horizontal plane symmetry exhibit by an antenna including sixteen elements.

FIGS. 3–7 generally show the performance of an embodiment 200 of an antenna in accordance with the principles of the present invention. More specifically, FIG. 3 shows the horizontal plane symmetry exhibited by a hooked stub collinear array antenna 200 including sixteen radiating elements 202. As shown in FIG. 3, the radiation 204 from the antenna 200 is generally symmetric about a vertical axis of the antenna formed by the radiating elements 202. The main "beam" 206 is canted slightly downward, while the various "endfire" components 208 are typically greater than four decibels (4 dB) down from the main beam 206. Furthermore, the wideband performance of the antenna without a feed line or radome has gains of 11.08 decibels referenced to the antenna 200 at 5,150 Megahertz and 106 degrees, 11.29 decibels referenced to the antenna 200 at 5,400 Megahertz and 100 degrees, and 11.50 decibels referenced to the antenna 200 at 5,850 Megahertz and 92 degrees. This represents a hooked stub collinear array antenna 200 with moderate gain, e.g. greater than 10 decibels referenced to the antenna 200, with an array bandwidth greater than five percent.

Figure 4:
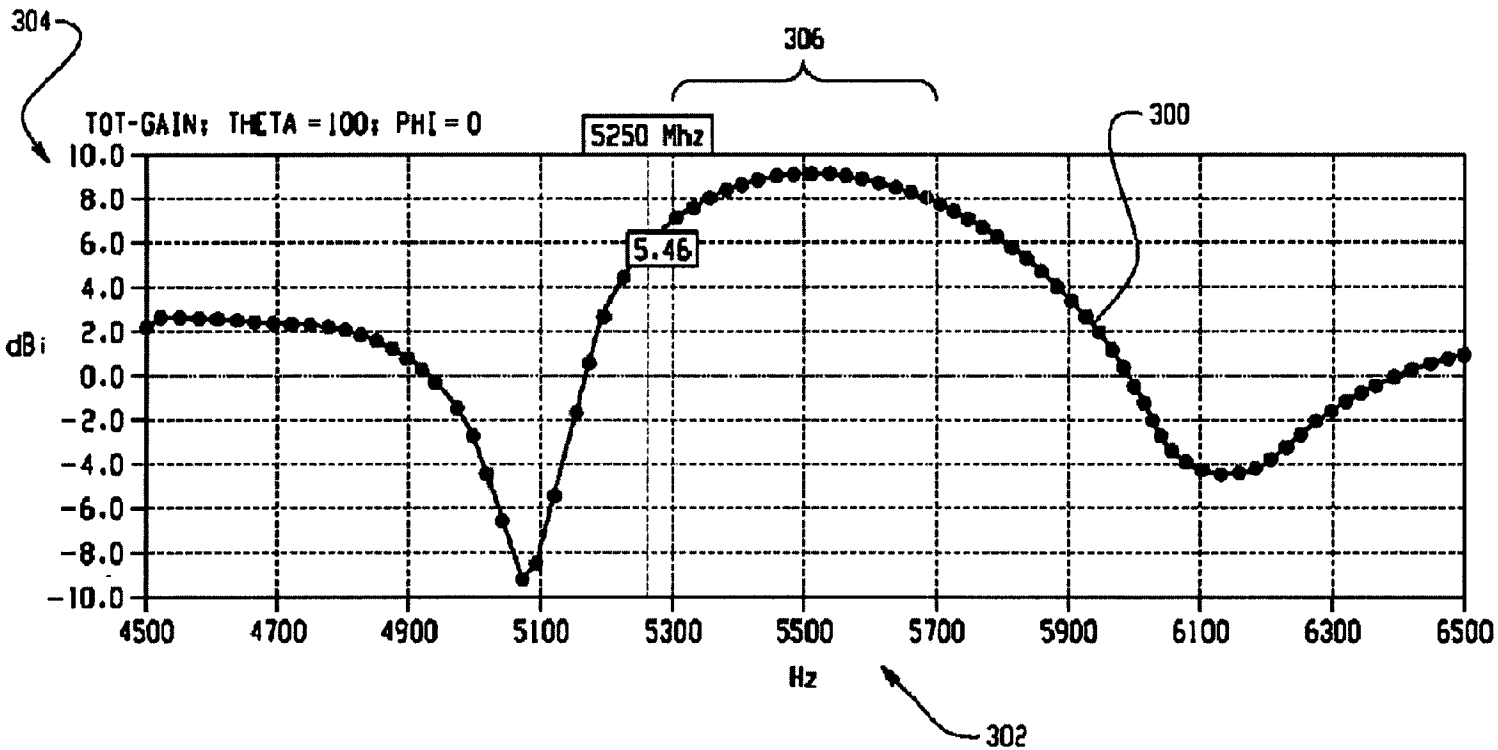
FIG. 4 is graph showing the gain and bandwidth of the antenna of FIG. 3.

FIG. 4 shows a graph 300 of the gain for hooked stub collinear array antenna 200 of FIG. 3. As shown in FIG. 4, the frequency is represented in MegaHertz (MHz) along the x-axis or abscissa 302, and the gain is represented in decibels referenced to the antenna 200 (dBi) along the y-axis, or ordinate 304. As shown, the gain is in excess of eight decibels across the band 306.

Figure 5:
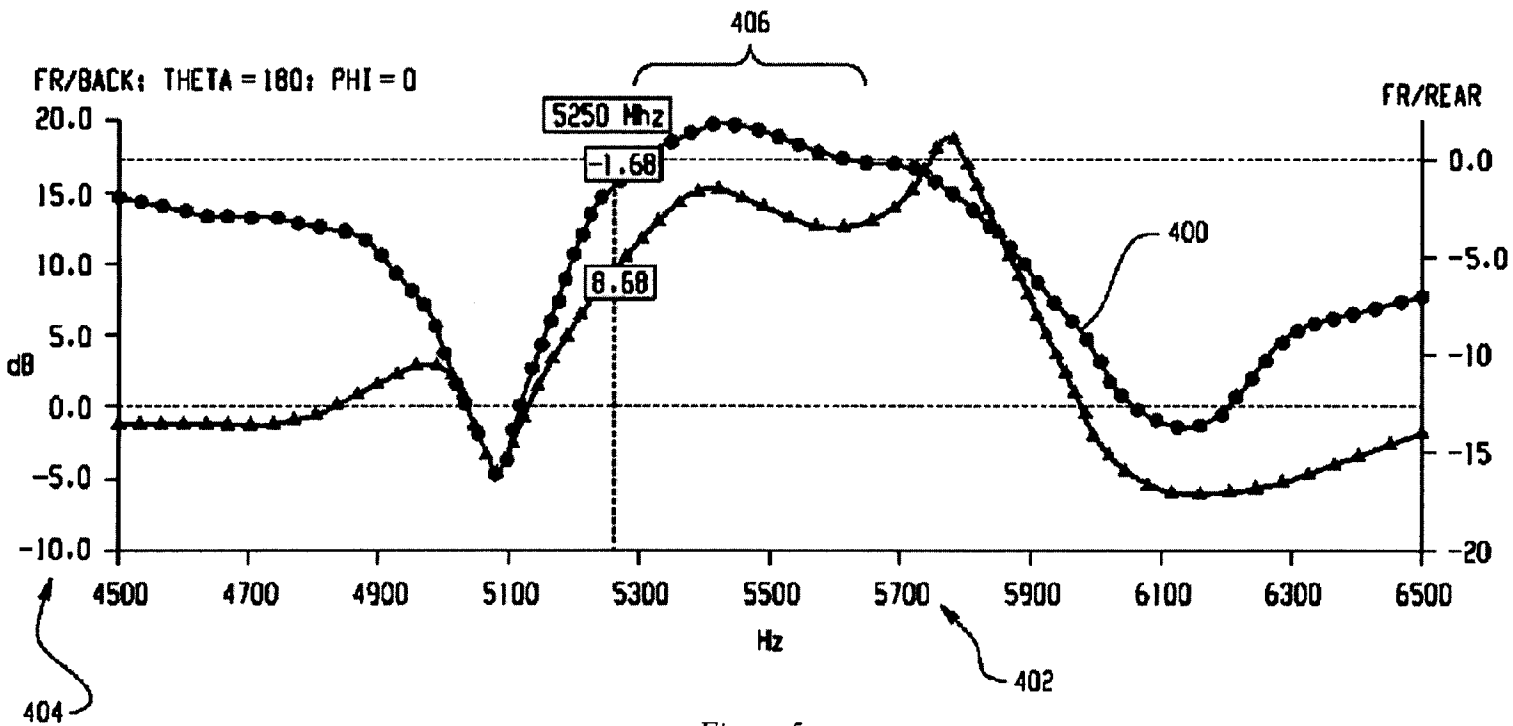
FIG. 5 is a graph showing the front-to-back ratio of the antenna of FIG. 3.

FIG. 5 shows a graph 400 of the front-to-back ratio for the hooked stub collinear array antenna 200 of FIG. 3. As shown in FIG. 5, the frequency is represented in MegaHertz (MHz) along the x-axis or abscissa 402, and the front-to-back ratio is represented in decibels (dB) along the y-axis, or ordinate 404. As shown, the front-to-back ratio is on the order of fifteen decibels across the band 406.

Figure 6:
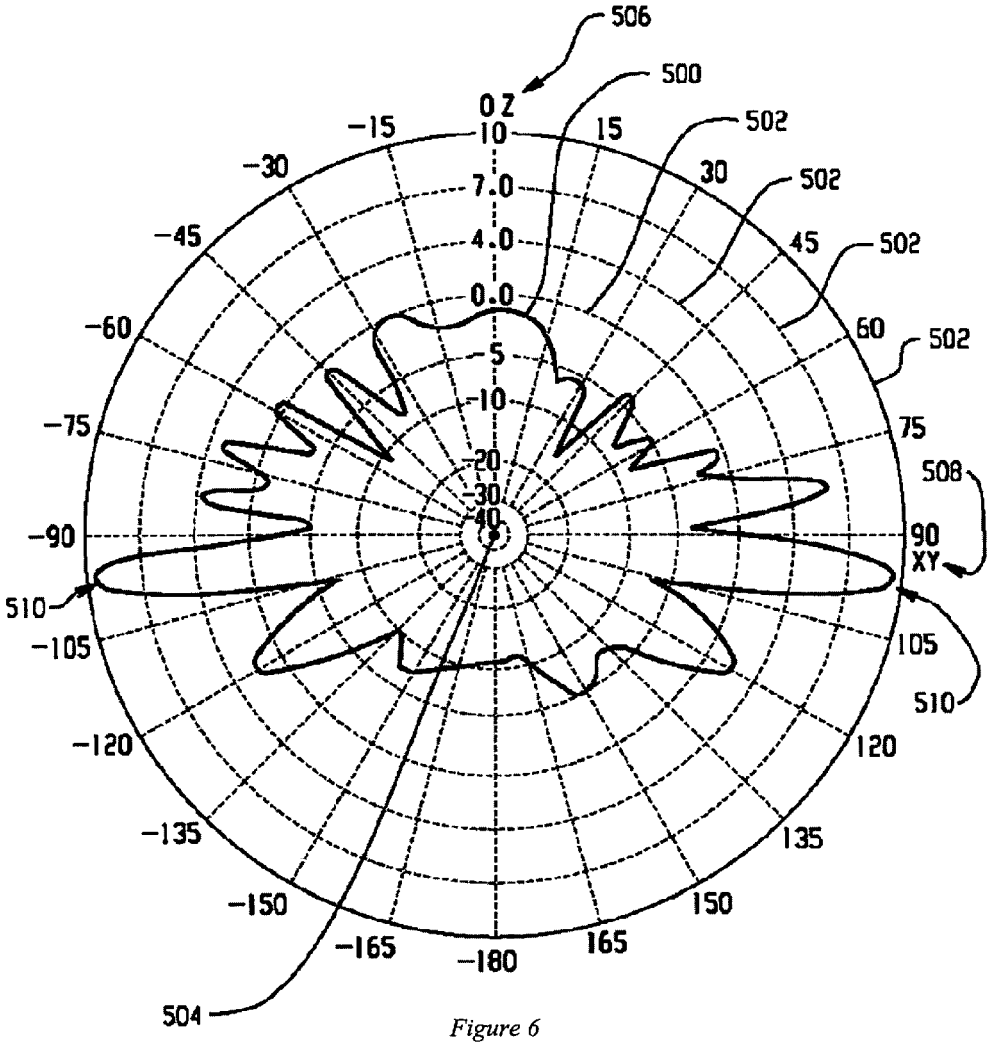
FIG. 6 is a graph showing the vertical gain pattern exhibited by the antenna of FIG. 3.

FIG. 6 shows a graph 500 indicating the vertical gain exhibited by the hook stub collinear array antenna 200 of FIG. 3. As shown in FIG. 6, the gain is in terms of decibels scaled as concentric rings 502 about an origin 504. The vertical axis of the antenna 200 is represented as the "Z-axis" found at reference numeral 506, while the horizontal plane is represented as the XY-axis found at reference numeral 508. More specifically, the graph 500 shown is a typical vertical cut taken at a frequency of 5,600 Megahertz. Again, as also shown and described in conjunction with FIG. 3, the omni-directional main beam is canted down at approximately five degrees, as indicated at reference numeral 510.

Figure 7:
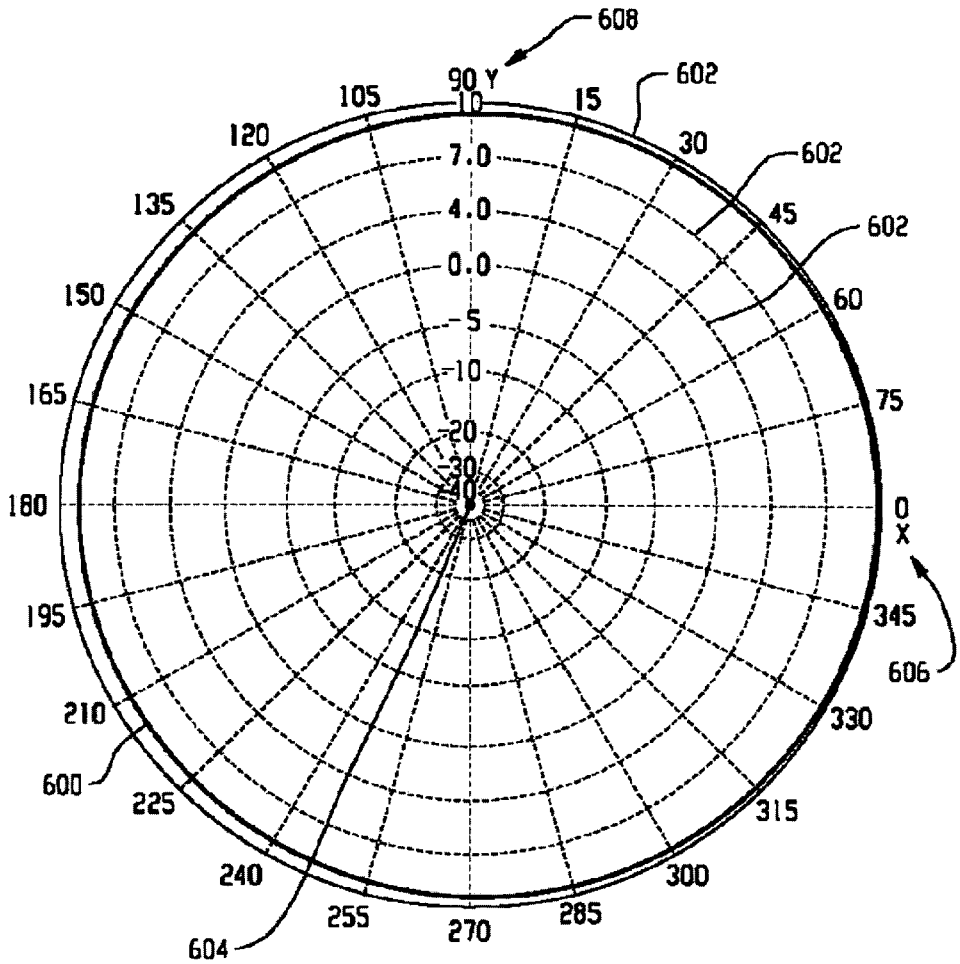
FIG. 7 is a graph showing the horizontal gain pattern exhibited by the antenna of FIG. 3.

FIG. 7 shows a graph 600 indicating the horizontal gain exhibited by the hook stub collinear array antenna 200 of FIG. 3. Similarly, as shown in FIG. 7, the gain is in terms of decibels shown as concentric rings 602 about an origin 604. The X and Y axis, found at reference numeral 606 and 608, respectively, represent the horizontal plane of the antenna 200. Thus, the graph 600 shown is a typical horizontal cut also taken at a frequency of 5,600 Megahertz. Again, the graph 600 indicates omni-directional coverage with very good or superb horizontal plane symmetry.

By virtue of the foregoing, there is thus provided an omni-directional antenna with vertical polarization characteristics, a uniform horizontal plane pattern, low cross-polarization characteristics, and moderate gain, with greater than five percent bandwidth. Moreover, such an omni-directional antenna is easy to manufacture.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. It will be understood that the present invention is applicable to any elongated electrically conductive structure. Moreover, such an antenna is not limited to uses in any particular frequency band; but rather, may be designed for and operate at any frequency as desired. Therefore, the invention, in its broader aspects, is not limited to the specific details, the representative apparatus, and illustrative examples shown and described. Accordingly, departures may be made from such details without departing from the spirit or scope of the applicants' general inventive concept.

What is claimed is:

1. A hooked stub collinear array antenna formed from a single conductor and configured to operate at a design frequency having a wavelength, comprising:

a plurality of radiating elements that are substantially one half the wavelength aligned with a longitudinal axis;

a delay element connected between each of the plurality of radiating elements, wherein there are at least two delay elements;

wherein the delay element is aligned with a corresponding transverse axis approximately ninety degrees from the longitudinal axis, the delay element extending approximately one quarter of the wavelength from the longitudinal axis, the total length of the delay element is approximately one half the wavelength; and wherein the corresponding transverse axis of the delay element is serially rotated by ninety degrees from the corresponding transverse axis of a next delay element.

2. The hooked stub collinear array antenna of claim 1, wherein there are at least four radiating elements.

3. The hooked stub collinear array antenna of claim 1, wherein the plurality of radiating elements is a multiple of four.

4. The hooked stub collinear array antenna of claim 1, wherein the proximal end of the delay elements extend along a transverse axis and are serially rotated ninety degrees in a clockwise direction.

5. The hooked stub collinear array antenna of claim 1, wherein the proximal end of the delay elements are serially rotated ninety degrees in a counterclockwise direction.

6. The hooked stub collinear array antenna of claim 1, wherein the wherein the delay elements are substantially U shaped.

7. The hooked stub collinear array antenna of claim 6, the delay elements further comprising a substantially ninety degree bend about an axis parallel to the longitudinal axis of the antenna.

8. The hooked stub collinear array antenna of claim 1, wherein the delay elements are substantially rectangular in shape.

9. The hooked stub collinear array antenna of claim 1, wherein the delay elements are substantially J shaped.

10. The hooked stub collinear array antenna of claim 1, wherein the delay elements are substantially similar.

11. The hooked stub collinear array antenna of claim 10, wherein the delay elements are symmetric about the longitudinal axis and substantially perpendicular to the longitudinal axis.

12. The hooked stub collinear array antenna of claim 11, wherein the delay elements are rotated in one of a clockwise and counterclockwise direction along the longitudinal axis.

13. The hooked stub collinear array antenna of claim 1, wherein the height of the delay elements along the longitudinal axis is less than 1/20 the wavelength.

14. A hooked stub collinear array antenna formed from a single conductor and configured to operate at a design frequency having a wavelength, comprising:

a plurality of radiating elements that are substantially one half the wavelength in length and aligned with a vertical axis, comprising first, second and third radiating elements;

a first delay element between the first and second radiating elements;

wherein the first delay element is aligned with a first horizontal axis approximately ninety degrees from the vertical axis extending approximately one quarter of the wavelength, the total length of the delay element is approximately one half the wavelength; and a second delay element between the second and third radiating elements;

wherein the second delay element is aligned with a second horizontal axis approximately ninety degrees from the vertical axis extending approximately one quarter of the wavelength, the total length of the delay element is approximately one half the wavelength and the first and second horizontal axis are rotated by ninety degrees about the vertical axis.

15. The hooked stub collinear array antenna of claim 14, wherein the plurality of radiating elements is a multiple of four.

16. The hooked stub collinear array antenna of claim 14, wherein the proximal end of the delay elements extend along a transverse axis and are serially rotated ninety degrees in one of a clockwise direction and a counterclockwise direction.

17. The hooked stub collinear array antenna of claim 14, wherein the wherein the delay elements are one of substantially U shaped, substantially rectangular in shape, and substantially J shaped.

18. The hooked stub collinear array antenna of claim 14, the delay elements further comprising a substantially ninety degree bend about an axis parallel to the longitudinal axis of the antenna.

19. The hooked stub collinear array antenna of claim 14, wherein the delay elements are substantially similar.

20. The hooked stub collinear array antenna of claim 14, wherein the delay elements are symmetric about the vertical axis and substantially perpendicular to the vertical axis.

21. The hooked stub collinear array antenna of claim 14, wherein the height of the delay elements along the vertical axis is less than 1/20 the wavelength.

22. The hooked stub collinear array antenna of claim 14, further comprising:

the plurality of radiating elements further comprises a fourth radiating element; and a third delay element between the third and fourth radiating elements;

wherein the third delay element is aligned with a third horizontal axis approximately ninety degrees from the vertical axis extending approximately one quarter of the wavelength, the total length of the delay element is approximately one half the wavelength and the second and third horizontal axis are rotated by ninety degrees about the vertical axis.

23. The hooked stub collinear array antenna of claim 22, further comprising:

the plurality of radiating elements further comprises a fifth radiating element; and a fourth delay element between the fourth and fifth radiating elements;

wherein the fourth delay element is aligned with a fourth horizontal axis approximately ninety degrees from the vertical axis extending approximately one quarter of the wavelength, the total length of the delay element is approximately one half the wavelength and the fourth and fifth horizontal axis are rotated by ninety degrees about the vertical axis.

24. The hooked stub collinear array antenna of claim 22, wherein the second horizontal axis is rotated 90 degrees from the first horizontal axis in a clockwise direction and the third horizontal axis is rotated 90 degrees from the second horizontal axis in a clockwise direction.

25. The hooked stub collinear array antenna of claim 22, wherein the second horizontal axis is rotated 90 degrees from the first horizontal axis in a counterclockwise direction and the third horizontal axis is rotated 90 degrees from the second horizontal axis in a counterclockwise direction.

* * * * *